US012024212B2

(12) United States Patent
Xia et al.

(10) Patent No.: US 12,024,212 B2
(45) Date of Patent: Jul. 2, 2024

(54) TRAIN MOVEMENT AUTHORIZATION METHOD BASED ON VEHICLE-TO-VEHICLE COOPERATION

(71) Applicant: CASCO SIGNAL CO., LTD., Shanghai (CN)

(72) Inventors: Tingkai Xia, Shanghai (CN); Xiang Chen, Shanghai (CN); Ke Cui, Shanghai (CN); Xinjun Lv, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 770 days.

(21) Appl. No.: 16/978,293

(22) PCT Filed: Mar. 15, 2019

(86) PCT No.: PCT/CN2019/078247
§ 371 (c)(1),
(2) Date: Sep. 4, 2020

(87) PCT Pub. No.: WO2019/233153
PCT Pub. Date: Dec. 12, 2019

(65) Prior Publication Data

US 2020/0406943 A1 Dec. 31, 2020

(30) Foreign Application Priority Data

Jun. 6, 2018 (CN) ..... 201810575896.4

(51) Int. Cl.
*B61L 23/00* (2006.01)
*B61L 27/20* (2022.01)

(52) U.S. Cl.
CPC ..... *B61L 23/00* (2013.01); *B61L 27/20* (2022.01); *B61L 2027/204* (2022.01)

(58) Field of Classification Search
CPC .... B61L 23/00; B61L 27/20; B61L 2027/204; B61L 27/70; B61L 25/025
(Continued)

(56) References Cited

U.S. PATENT DOCUMENTS 9,718,487 B2 * 8/2017 Ghaly ..... B61L 27/20
10,259,478 B1 * 4/2019 Gao ..... B61L 27/20
(Continued)

FOREIGN PATENT DOCUMENTS

CN 104149821 A * 11/2014
CN 104149821 A 11/2014
(Continued)

OTHER PUBLICATIONS

"Sehchan Oh, Yongki Yoon, Minsoo Kim, Yongkyu Kim, ATP Functional Allocation for Korean Radio based Train Control System, Oct. 17, 2012, 12th International Conference on Control, Automation and Systems" (Year: 2012).*
(Continued)

*Primary Examiner* — Elaine Gort
*Assistant Examiner* — Christopher R Cardimino
(74) *Attorney, Agent, or Firm* — HSML P.C.

(57) ABSTRACT

A train movement authorization method includes obtaining, by a train, current task information from an automatic train supervision system; obtaining, by the train, current resource allocation information from a trackside resource management center; reckoning, by the train, a first train in an operation direction downstream of the train based on the received resource allocation information; sending, by the train, a location request to the first train in the operation direction downstream of the train based on an operation task of the train and responding to a location request of another train; calculating, by the train, movement authorization of the train based on train information sent by the first train
(Continued)

downstream in the operation direction; and applying for, by the train, a corresponding line resource from the trackside resource management center based on the task of the train and a status of the calculated movement authorization.

7 Claims, 5 Drawing Sheets

(58) Field of Classification Search
USPC ..... 701/19
See application file for complete search history.

(56) References Cited

U.S. PATENT DOCUMENTS

| | | | | |
|---|---|---|---|---|
| 10,297,153 | B2 * | 5/2019 | Gao | G08G 1/096833 |
| 11,148,691 | B2 * | 10/2021 | Gao | B61L 27/70 |
| 2010/0241296 | A1 * | 9/2010 | Rhea, Jr. | B60T 13/665 701/20 |

FOREIGN PATENT DOCUMENTS

| | | | | | |
|---|---|---|---|---|---|
| CN | 106515797 | A | | 3/2017 | |
| CN | 107054413 | A | | 8/2017 | |
| CN | 107284471 | A | | 10/2017 | |
| CN | 107650949 | A | | 2/2018 | |
| CN | 107745729 | A | | 3/2018 | |
| CN | 106828542 | B | * | 8/2018 | B61L 23/34 |
| CN | 109080667 | A | | 12/2018 | |
| CN | 107757656 | B | * | 2/2020 | B60T 7/12 |
| WO | 2018091231 | A1 | | 5/2018 | |

OTHER PUBLICATIONS

International Search Report (in English and in Chinese) and Written Opinion issued in PCT/CN2019/078247, mailed Jun. 14, 2019, 12 pages provided.

* cited by examiner

TRAIN MOVEMENT AUTHORIZATION METHOD BASED ON VEHICLE-TO-VEHICLE COOPERATION

FIELD OF TECHNOLOGY

The present invention relates to the technical field of security control of rail transport signals, and in particular, to a train movement authorization method based on vehicle-to-vehicle cooperation.

BACKGROUND

A core system of a traditional communication based train control system (CBTC)—an "automatic train protection system" (ATP) consists of two parts: a trackside part and an on-board part. The trackside part is mainly responsible for collecting information of trackside devices and trains, calculating movement authorization for all trains on a line, and sending the movement authorization to an on-board ATP. To achieve this function, the trackside ATP must maintain positions and status information of all trains within a management region of the trackside ATP and a management region of an adjacent trackside ATP. In addition, the trackside ATP must further maintain information of a train on a boundary of an adjacent trackside ATP on a boundary of the current trackside ATP, to ensure that the train can operate without stopping in management regions of a plurality of trackside ATP devices. The trackside ATP undertakes key functions and has a relatively large management region, and therefore, has strict requirements on reliability. Therefore, simplifying a design of the trackside ATP as much as possible to reduce a probability that the trackside ATP goes wrong is an important direction for designing and developing the CBTC system. Core functions of the trackside ATP—train information maintenance and movement authorization calculation not only involve a large quantity of numerical calculation, but also require support of complex interfaces between adjacent trackside ATPs. If such functions are designed to be calculated by the on-board ATP, a numerical calculation function of the trackside ATP and an interface between the trackside ATPs are completely removed, so that complexity of the entire CBTC system can be greatly simplified.

In a train movement authorization method based on vehicle-vehicle cooperation, train movement authorization is calculated through direct information interaction between trains, including operation modes such as train tracking and face-to-face driving. The trackside ATP is only responsible for maintaining sequence information of online operating trains and providing the information to the on-board ATP.

SUMMARY

The present invention provides a method for person re-identification based on a depth multi-loss fusion model to overcome the shortcomings existing in the prior art.

The purpose of the disclosure may be realized by the following technical solutions.

A train movement authorization method based on vehicle-to-vehicle cooperation is provided, where the method includes the following steps:

step 1: obtaining, by a train, current task information from an automatic train supervision system (ATS);

step 2: obtaining, by the train, current resource allocation information from a trackside resource management center;

step 3: reckoning, by the train, a first train in downstream of an operation direction of the train based on the received resource allocation information;

step 4: sending, by the train, a location request to the first train in downstream of the operation direction of the train based on an operation task of the train and responding to a location request of another train;

step 5: calculating, by the train, movement authorization of the train based on train information sent by the first train in downstream of the operation direction; and step 6: applying for, by the train, a corresponding line resource from the trackside resource management center based on the task of the train and a status of the calculated movement authorization.

Preferably, after the obtaining, by a train, task information of the current train from an automatic train supervision system (ATS) in step 1, the train calculates, based on a current train task, a list of all track resources that the train needs to sequentially pass through.

Preferably, after the obtaining, by the train, current resource allocation information from a trackside resource management center in step 2, the resource allocation information is described by using train sequences in a train information container (TIC).

Preferably, the TIC is an approach used to divide a track section based on resources, and the TIC is a section without a fork or is a turnout; an ID of the train appearing in one TIC indicates that the trackside resource manager considers that the train is capable of using the TIC resource.

Preferably, if an ID of only the current train exists in the train information container (TIC) in step 2, a movement authorization range of the train crosses a track section corresponding to the entire TIC.

Preferably, if an ID of another train exists in the train information container (TIC) in step 3, the current train determines an ID of a first train in downstream of the current train based on an operation direction of the current train and an order of arranging train IDs in the TIC (the train IDs in the TIC are arranged in an agreed order, for example, along an up direction of a line).

Preferably, the train calculates an expected train envelope (ETE) based on the task information of the train and calculates a guaranteed train envelope (GTE) based on a current operation status of the train in step 4, and the expected train envelope (ETE) and the guaranteed train envelope (GTE) are used to respond to a movement authorization report for a movement authorization request of another train.

Preferably, in step 4, the train calculates, based on the ETE, a movement authorization request that needs to be sent to the downstream train of the train, where the request includes ETE information of the current train.

Preferably, in step 5, the current train calculates the movement authorization of the train based on a movement authorization request and a movement authorization report that are sent by the downstream first train of the current train, and calculates a movement authorization report used to respond to a movement authorization request of another train.

Preferably, in step 6, the train determines, based on a current movement authorization location and by comparing operation tasks of trains, a next TIC that the train needs to apply for, and generates a resource application request to be sent to the resource management center.

Compared with the prior art, the present invention has the following advantages:

1. In the method of the present invention, a movement authorization calculation function in a design of an existing CBTC system is changed to on-board direct calculation through vehicle-to-vehicle information interaction, to replace a centralized calculation method of a trackside ATP in the existing CBTC system.

2. Based on the present invention, complexity of the trackside ATP is reduced, and a numerical calculation module of the trackside ATP and an interface between trackside ATPs are completely removed.

3. The on-board ATP in the present invention implements train tracking, track resource competition and coordination, and train face-to-face operation with higher efficiency through vehicle-to-vehicle information interaction that is based on a request/confirmation mechanism.

BRIEF DESCRIPTION OF THE DRAWINGS

FIG. 4 is a schematic diagram of an operation principle of train tracking and face-to-face operation based on a request/confirmation mechanism.

DESCRIPTION OF THE EMBODIMENTS

The technical solutions in the embodiments of the present invention are clearly and completely described hereafter. It is apparent that the described embodiments are some rather than all of the embodiments of the present invention. Based on the embodiments of the present invention, all the other embodiments obtained by those of ordinary skill in the art without inventive effort shall fall within the protection scope of the present invention.

Figure 1:
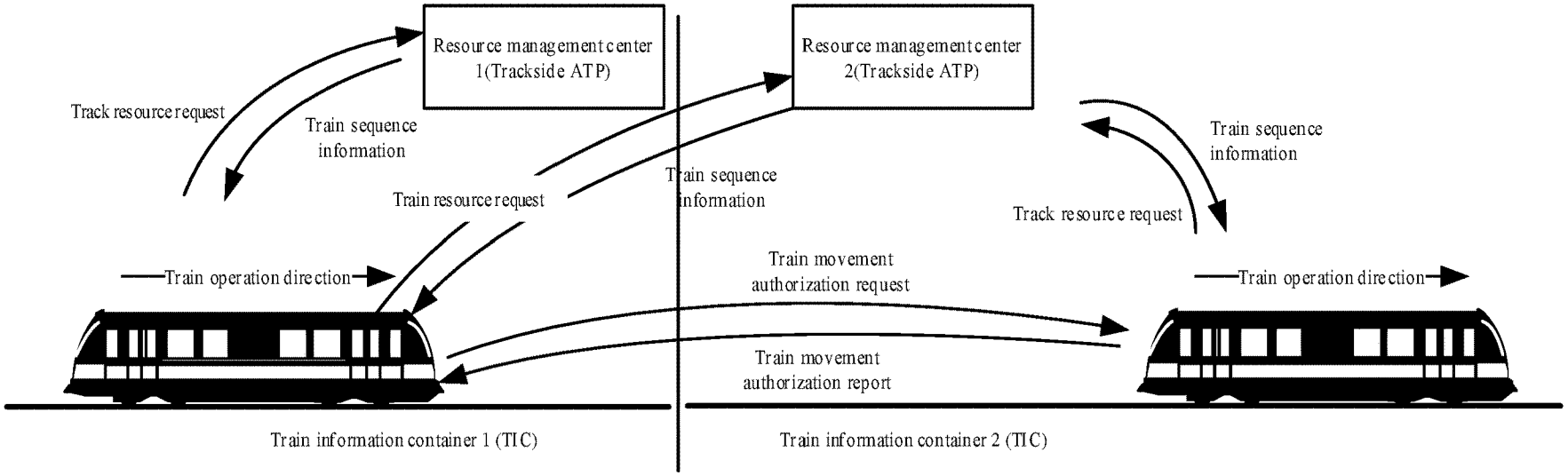
FIG. 1 is a topological structure diagram of information interaction between a resource management center (trackside ATP) and an on-board ATP.

A topological structure of vehicle-to-ground/vehicle-to-vehicle communication of a CBTC system based on vehicle-to-vehicle cooperation is shown in FIG. 1. In the system, no information is exchanged between resource management centers (trackside ATPs). An on-board ATP needs to calculate, based on an operation direction, a location, and speed information of a train, a management region of a resource management center in which the train is currently located, and send a track resource request to the resource management center in which the train is currently located and a resource management center that the train is to enter. After receiving train sequence information from the resource management center, the train determines a next train in the operation direction of the train based on train order information on a current track, requests for movement authorization from the downstream train based on a train movement authorization request, and accordingly calculates movement authorization of the train after receiving a train movement authorization report returned by the train.

When performing information interaction with another train, the train first needs to obtain information of "which trains need to be interacted with". This information is maintained by the trackside ATP (the resource management center), sent to the on-board ATP and is described by using a train sequence on a track section (description is performed by using a TIC). Based on the sequence, the on-board ATP may determine ID information of a closest train in downstream of the operation direction of the train. The on-board ATP calculates movement authorization of the on-board ATP by directly requesting for train information from a downstream train in the operation direction. In addition to basic train operation information (a location, a speed, and a direction), information that the train needs to exchange should further include an expected train envelope (ETE) and a guaranteed train envelope (GTE).

Figure 2:
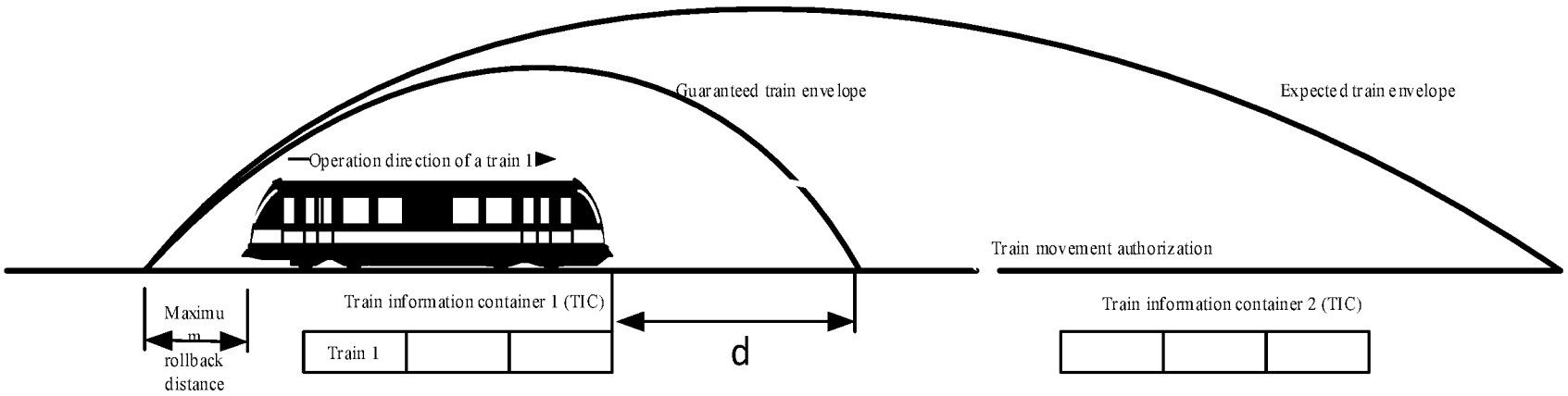
FIG. 2 is a schematic diagram of a calculation principle of an expected train envelope and a guaranteed train envelope.

As shown in FIG. 2, the train calculates the "guaranteed train envelope", the "expected train envelope", and train movement authorization based on a current track resource allocation status, train sequence information, and an operation status of the train. The ETE is calculated by the train based on an operation task of the train, and a range of the ETE is from a smallest secure back end where the train considers a maximum rollback to a remote end of a next TIC that the train expects to enter. A starting point of the GTE is the same as that of the ETE. An ending point of the GTE is obtained by extending a maximum head security location of the train by a distance in a train moving direction. This distance is a farthest distance that the train can move from a current moment when the train starts to respond to a braking instruction of the on-board ATP to a moment when the train completely stops, and is calculated according to the following function:

$$d=f(t_1, t_2, v_t, a_m, a_s, a_e)$$

where $t_1$ is a traction removing time of the train, $t_2$ is a braking application time of the train, $v_t$ is a current operation speed of the train, $a_m$ is a maximum traction acceleration of the train, $a_s$ is an equivalent acceleration of the train on a maximum slope, $a_e$ is a guaranteed emergency braking acceleration (negative value) of the train.

A basic calculation principle is that after the on-board ATP issues a braking instruction, the train goes through the following three stages:

traction removing: at an acceleration stage, the train still has traction;

braking application: at a coasting stage, the traction of the train has been removed, but the train is still affected by the equivalent slope acceleration; and emergency braking: a process in which the train stops under an action of the guaranteed emergency braking acceleration.

Operation distances at the above three stages are separately calculated as follows:

$$d_1 = v_t t_1 + \frac{1}{2}(a_m + a_s)t_1^2$$

$$d_2 = (v_t + (a_m + a_s)t_1)t_2 + \frac{1}{2}a_s t_2^2$$

$$d_3 = \frac{0^2 - (v_t + (a_m + a_s)t_1 + a_s t_2)^2}{2(a_e + a_s)}$$

Therefore, a distance that the guaranteed train envelope needs to extend from a maximum train head location to the operation direction of the train is:

$$d=f(t_1, t_2, v_t, a_m, a_s, a_e)=\Sigma_{i=1}^{3}d_i.$$

Figure 5:
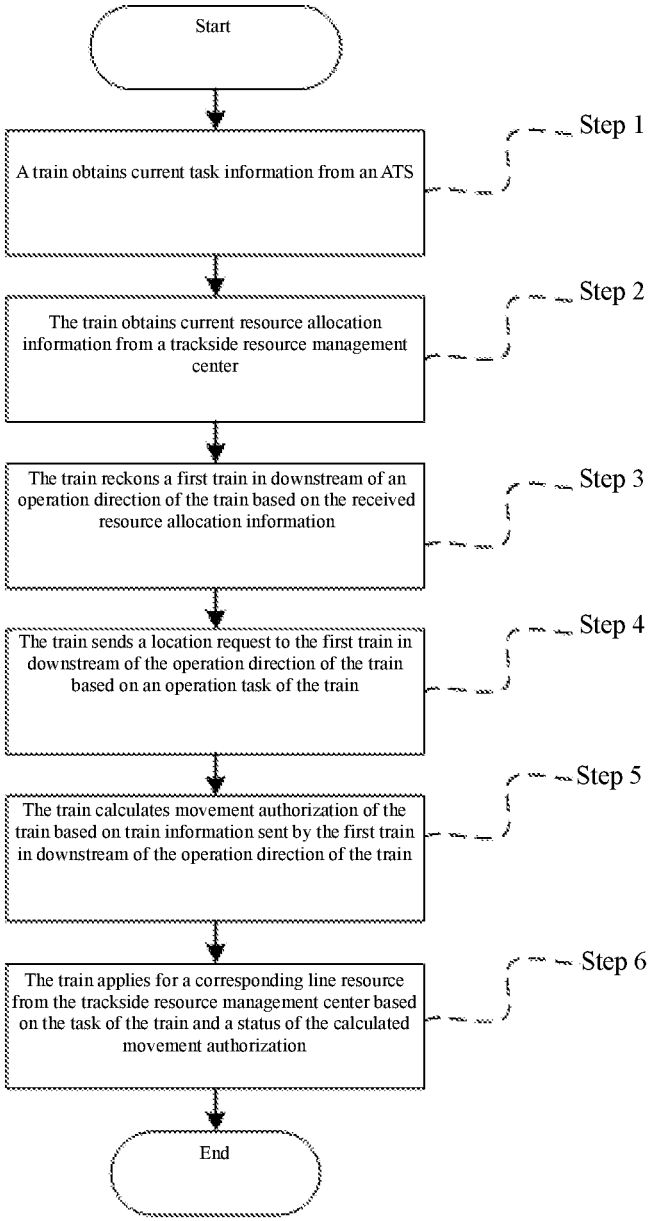
FIG. 5 is a flowchart of a train movement authorization method based on vehicle-to-vehicle cooperation according to the present invention.

In a procedure shown in FIG. 5, in step 1 and step 2, the train separately obtains, from the ATS and the trackside resource management center, global information required for calculating movement authorization, and the global information includes a task of a current train and a train sequence of a current line. In step 3, the train calculates an ID of a first train in downstream of an operation direction of the train based on sequence information of the current train sent by the resource management center.

In step 4, the on-board ATP calculates an "expected train envelope" based on an operation task of the train, and if the ID that is calculated in the previous step and that is of the first train in downstream of the operation direction is valid, the on-board ATP should send the "expected train envelope" to the downstream train of the train by using a movement authorization request, and the movement authorization should not be extended before a reply from the downstream train is obtained. In addition to location and direction information, the "expected train envelope" should further include a time identifier (indicated by a count of a main period of the on-board ATP) when the train sends the information and an operation priority of the train. When receiving an "expected train envelope" sent by another train, the on-board ATP should first determine whether a priority of the train sending the expected envelope is higher than that of the current train, and if the priority of the train sending the expected envelope is higher than that of the current train, an ending point of the "expected train envelope" should be a limiting point for calculating movement authorization of the current train. If the ending point of the "expected train envelope" falls within a range of a "guaranteed train envelope" of the current train, the current train should apply emergency braking. If the ending point of "expected train envelope" falls within downstream of an ending point of the "guaranteed train envelope" of the current train, the ending point of the "guaranteed train envelope" sent by the current train by using the train movement authorization report should be extended to the ending point of the "expected train envelope". If the current train finds that a priority of the train sending the request is lower than that of the current train, a "guaranteed train envelope" in a to-be-returned train movement authorization report should be set to an invalid value.

In step 5, after receiving the train movement authorization report returned by the downstream train, the on-board ATP first determines timeliness of the train movement authorization report, and if a time identifier included in the train movement authorization report is not less than a time identifier of a moment when the current train initiates a train movement authorization request, the current train should use the "guaranteed train envelope" in the train movement authorization report, and calculate movement authorization of the train.

Figure 3:
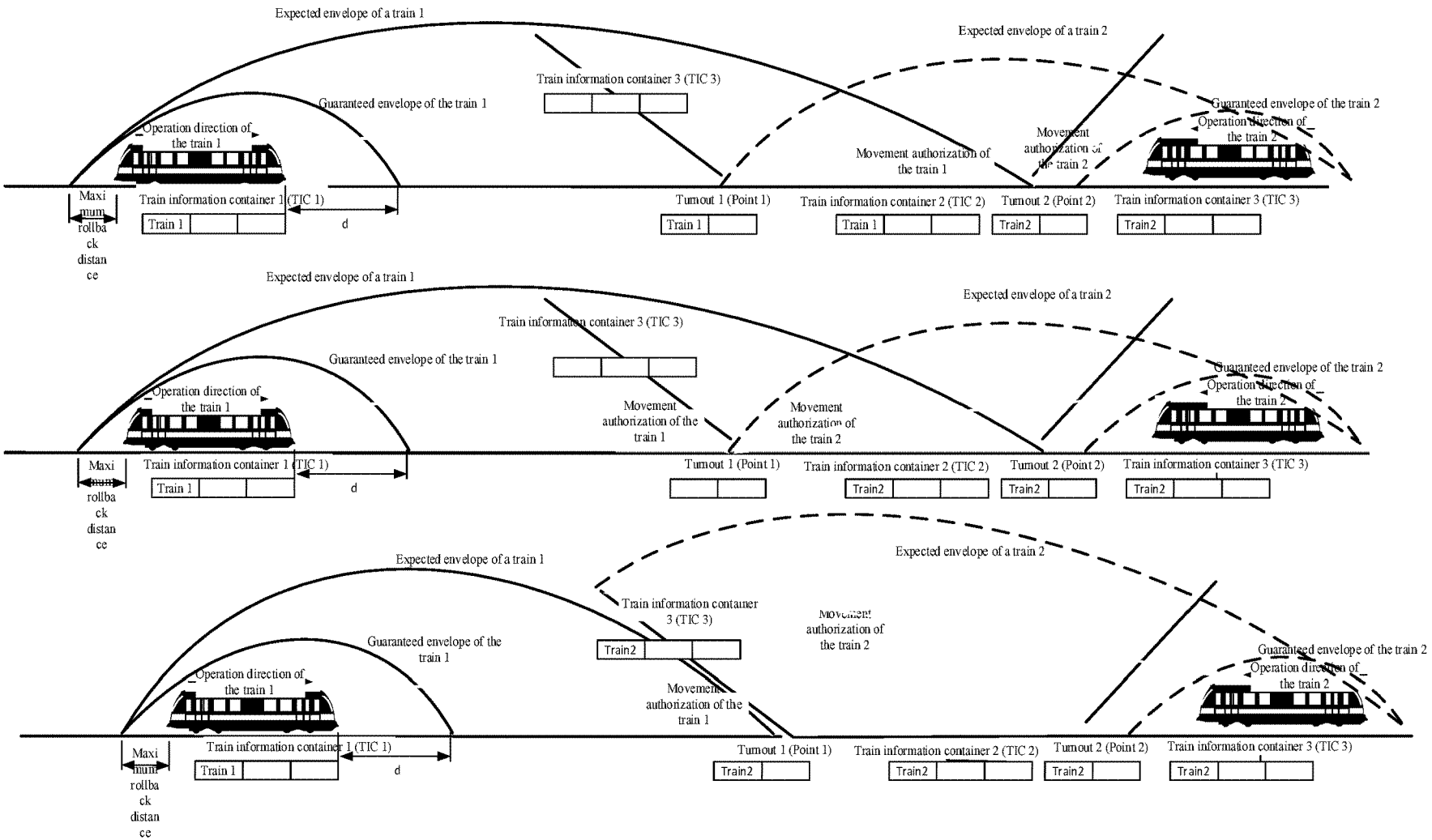
FIG. 3 is a typical flowchart of resource competition of an on-board ATP during face-to-face operation of trains.

FIG. 3 is a typical procedure of resource competition of an on-board ATP during face-to-face operation. In a shown scenario, it is assumed that a train 2 has a relatively high traffic priority, but movement authorization of a train 1 first extends into a TIC 2 and reaches a turnout 2. The train 1 starts to apply to the resource management center for a resource of the turnout 2. However, because the turnout 2 has been allocated by the resource management center to the train 2 in an opposite direction, the train 1 cannot obtain use authorization of the turnout 2. After movement authorization of the train 2 reaches the turnout 2, the train 2 starts to continue applying for a next track resource in an operation direction of the train 2, that is, the TIC 2. The train 2 extends an expected envelope of the train 2 to a remote end of the TIC 2, and sends the expected envelope to the train 1 by using a train movement authorization request. After receiving the movement authorization request, the train 1 determines that a movement authorization location requested by the train 2 overlaps movement authorization currently used by the train 1 but has not entered a guaranteed train envelope of the train 1. In this way, the train 1 actively withdraws the movement authorization of the train 1 to an end point of a TIC 1 (it is ensured that the movement authorization of the train 1 does not overlap an expected envelope of an oncoming train), sends a "guaranteed movement authorization" location to the train 2 as a mobile authorization location by using a train movement authorization report after the withdrawal, and actively cancels the turnout 1 and the TIC 2 from the resource management center. After the turnout 1 is successively canceled, the resource management center can continue processing application of the train 2 for a resource of the turnout 1. After the train 2 successively obtains an inverted resource of the turnout 1 through application, the train 2 can continue applying for a resource of a TIC 3 and implement a function of preferentially passing through a turnout region. For security reasons, when the low-priority train (the train 1) is processing a movement authorization request of an oncoming train, if the low-priority train finds that a movement authorization location requested by the oncoming train has entered a range of a guaranteed train envelope of the train, the on-board ATP shall send a tail end of the guaranteed train envelope of this train as "guaranteed movement authorization" when returning a train movement authorization report. For example, if a broken link point appears in the "guaranteed train envelope", causing retraction of movement authorization of a train, the train cannot cancel a resource based on the retracted movement authorization, to prevent a conflict caused by re-allocation of the resource to another train.

Figure 4:
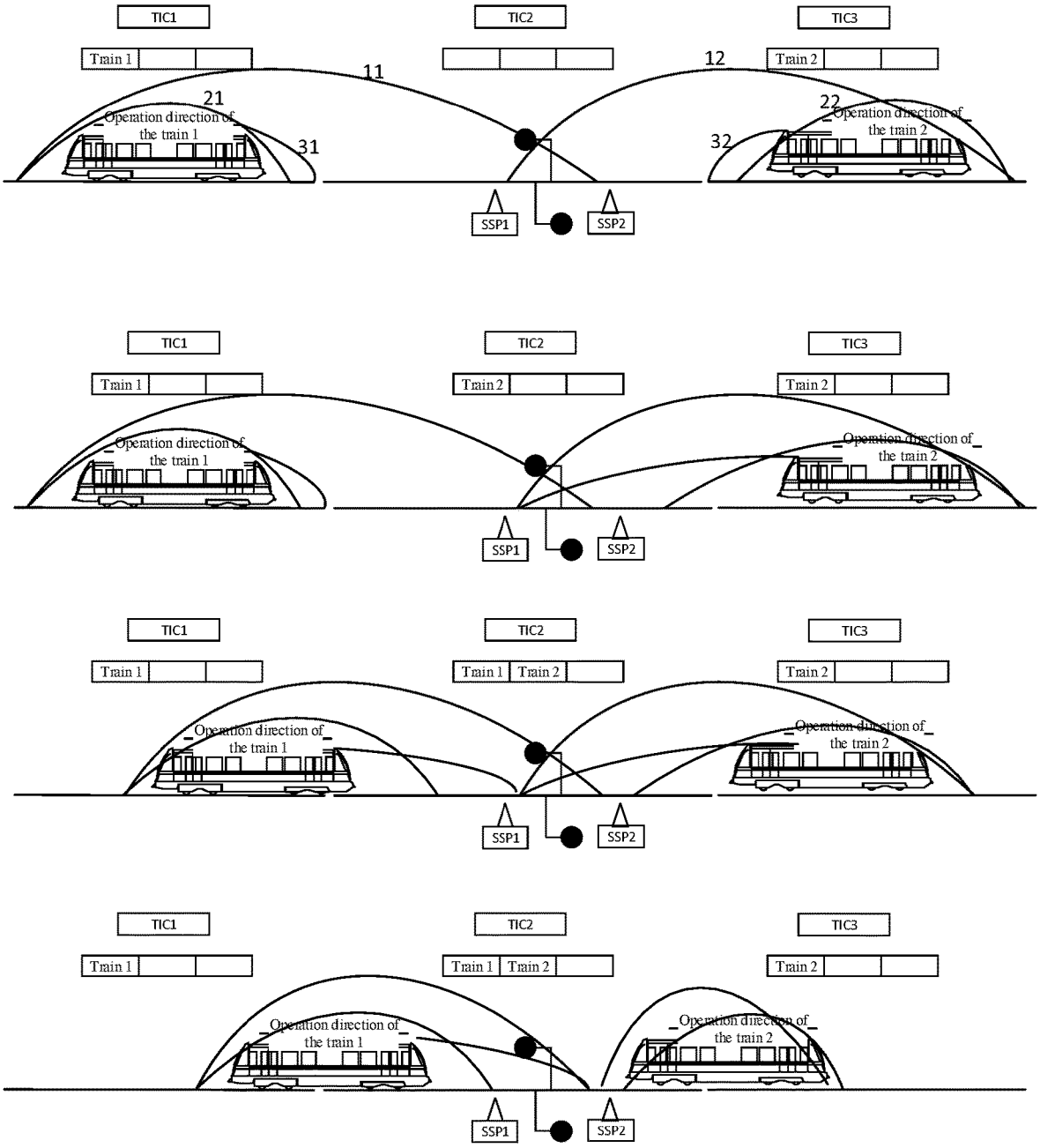
FIG. 4 is a schematic diagram of an operation principle of train tracking and face-to-face operation based on a request/confirmation mechanism, where 11 is an expected envelope of a train 1, 21 is a guaranteed envelope of the train 1, 31 is movement authorization of the train 1, 12 is an expected envelope of a train 2, 22 is a guaranteed envelope of the train 2, and 32 is movement authorization of the train 2.

FIG. 4 is a typical scenario of face-to-face turnback operation of trains. It is assumed that a train 2 has a relatively high operation priority. A train 1 and the train 2 undergo a face-to-face turnback process during operation. Since two service stopping points (SSP) SSP 1 and SSP 2 are relatively close, if the trains turn back at the same time, resources that the trains need to apply for overlap, resulting in resource competition. In this case, the trains need to coordinate resource use by themselves. In the figure, the train 2 first applies for a resource of a TIC 2, and movement authorization of the train 2 extends into the TIC 2, so that it may be ensured that the train 2 accurately stops at a location of the SSP 2. When the train 1 also applies for the resource of TIC 2, the train 1 detects that the train 1 is not the only train in the TIC 2 based on train sequence information sent by the resource management center to the train 1, and there is another train (that is, the train 2) in downstream of the train 1. Before extending movement authorization of the train 1, the train 1 needs to first send a train movement authorization request packet to the train 2 to obtain an operation status of the train 2. After receiving the movement authorization request of the train 1, the train 2 determines that a priority of the train 1 is relatively low. In this case, the train 2 does not withdraw the movement authorization of the train 2, but sets, as guaranteed movement authorization, a resource limit location (that is, a tail end of an "expected train envelope" of the train 2, which is also a tail end of the movement authorization of the train 2) used by the train 2 and sends the guaranteed movement authorization to the train 1 by using a train movement authorization report. After receiving the guaranteed movement authorization, the train 1 may extend the movement authorization of the train 1 to a guaranteed movement authorization location in the TIC 2. After the train 2 accurately and stably stops, the train 2 sets the movement authorization of the train 2 to be invalid, and then retracts the expected train envelope. In this case, when receiving a new movement authorization request sent by the train 1, the train 2 uses a tail end of the retracted expected train envelope as a guaranteed movement authorization and sends the guaranteed movement authorization to the train 1, so that the train 1 may further extend the movement authorization of the train 1, to enable the train 1 to accurately stop at the SSP 1.

What is mentioned above is only the specific implementation of the present invention, but does not limit the protection scope of the present invention, and anyone skilled in the art can easily think of mortifications and alternations within the technical scope disclosed by the present invention, all of which shall fall within the protection scope of the present invention. Therefore, the protection scope of the present invention should be determined by the protection scope of the claims.

What is claimed is:

1. A train movement authorization method based on vehicle-to-vehicle cooperation, wherein the method comprises the following steps:

step 1: obtaining, by a train, current task information from an automatic train supervision system (ATS);

step 2: obtaining, by the train, current resource allocation information from a trackside resource management center;

step 3: reckoning, by the train, a first train in an operation direction downstream of the train based on the received resource allocation information;

step 4; sending, by the train, a location request to the first train in the operation direction downstream of the train based on an operation task of the train and responding to a location request of another train;

step 5: calculating, by the train, movement authorization of the train based on train information sent by the first train in the operation direction downstream of the train; and step 6: applying for, by the train, a corresponding line resource from the trackside resource management center based on the task of the train and a status of the calculated movement authorization, wherein in step 2, the resource allocation information is described by using train sequences in a train information container (TIC), wherein in step 4, the train determines an expected train envelope (ETE) based on the task information of the train and determines a guaranteed train envelope (GTE) based on a current operation status of the train, and the ETE and the GTE are used to respond to a movement authorization report for a movement authorization request of another train, wherein in step 6, the train determines, based on a current movement authorization location and by comparing operation tasks of trains, a next TIC that the train needs to apply for, and generates a resource application request to be sent to the resource management center, wherein the ETE is determined by the train based on an operation task of the train; the ETE ranges from a smallest secure back end where the train considers a maximum rollback to a remote end of a next TIC that the train expects to enter; a starting point of the GTE is the same as that of the ETE; an ending point of the GTE is obtained by extending a maximum head security location of the train by a distance in a train moving direction; the distance is a farthest distance that the train moves from a current moment when the train starts to respond to a braking instruction of an on-board automatic train protection system (ATP) to a moment when the train completely stops; and the distance is determined based on a traction removing time of the train $t_1$, a braking application time of the train $t_2$, a current operation speed of the train $v_t$, a maximum traction acceleration of the train $a_m$, an equivalent acceleration of the train on a maximum slope $a_s$, and a guaranteed emergency braking acceleration of the train $a_e$, wherein after the on-board ATP issues a braking instruction, the train goes through the following three stages:

traction removing: at an acceleration stage, the train has traction;

braking application: at a coasting stage, the traction of the train is removed, the train is affected by an equivalent slope acceleration; and emergency braking: a process in which the train stops under an action of the guaranteed emergency braking acceleration, wherein operation distances at the three stages are separately determined as follows, $$d_1 = v_t t_1 + \frac{1}{2}(a_m + a_s)t_1^2$$

$$d_2 = (v_t + (a_m + a_s)t_1)t_2 + \frac{1}{2}a_s t_2^2$$

$$d_3 = \frac{0^2 - (v_t + (a_m + a_s)t_1 + a_s t_2)^2}{2(a_e + a_s)}$$

wherein the distance that the GTE extends from a maximum train head location to the operation direction of the train is determined based on the operation distances at the three stages that are separately determined: $d=f(t_1, t_2, v_t, a_m, a_s, a_e)=\Sigma_{i-1}^{3} d_i$.

2. The train movement authorization method based on vehicle-to-vehicle cooperation according to claim 1, wherein after the obtaining, by a train, task information of the current train from an automatic train supervision system (ATS) in step 1, the train calculates, based on a current train task, a list of all track resources that the train needs to sequentially pass through.

3. The train movement authorization method based on vehicle-to-vehicle cooperation according to claim 1, wherein the TIC is an approach used to divide a track section based on resources, and the TIC is a section without a fork or is a turnout; an ID of the train appearing in one TIC indicates that the trackside resource manager considers that the train is capable of using the TIC resource.

4. The train movement authorization method based on vehicle-to-vehicle cooperation according to claim 3, wherein if an ID of only the current train exists in the train information container (TIC) in step 2, a movement authorization range of the train crosses a track section corresponding to the entire TIC.

5. The train movement authorization method based on vehicle-to-vehicle cooperation according to claim 3, wherein if an ID of another train exists in the train information container (TIC) in step 3, the current train determines an ID of a first train downstream of the current train based on an operation direction of the current train and an order of arranging train IDs in the TIC.

6. The train movement authorization method based on vehicle-to-vehicle cooperation according to claim 1, wherein in step 4, the train calculates, based on the ETE, a movement authorization request that needs to be sent to the downstream train of the train, wherein the request comprises ETE information of the current train.

7. The train movement authorization method based on vehicle-to-vehicle cooperation according to claim 1, wherein in step 5, the current train calculates the movement authorization of the train based on a movement authorization request and a movement authorization report that are sent by the first train downstream of the current train, and calculates a movement authorization report used to respond to a movement authorization request of another train.

* * * * *